US007094180B2

(12) United States Patent
Huang et al.

(10) Patent No.: US 7,094,180 B2
(45) Date of Patent: Aug. 22, 2006

(54) CONTROL DEVICE FOR A JOGGING MACHINE

(75) Inventors: Chin-Tang Huang, Tainan Hsien (TW); Ching-Tu Shih, Changhua Hsien (TW)

(73) Assignee: Tonic Fitness Technology, Inc., (TW)

( * ) Notice: Subject to any disclaimer, the term of this patent is extended or adjusted under 35 U.S.C. 154(b) by 0 days.

(21) Appl. No.: 10/968,148

(22) Filed: Oct. 20, 2004

(65) Prior Publication Data

US 2006/0084552 A1 Apr. 20, 2006

(51) Int. Cl.
*A63B 22/00* (2006.01)

(52) U.S. Cl. ..... 482/8; 482/51; 482/54; 482/900

(58) Field of Classification Search ..... 482/1–9, 482/51, 54, 900–902; 119/700
See application file for complete search history.

(56) References Cited

U.S. PATENT DOCUMENTS 5,368,532 A * 11/1994 Farnet ..... 482/5
5,800,314 A * 9/1998 Sakakibara et al. ..... 482/54
6,135,924 A * 10/2000 Gibbs et al. ..... 482/54
6,179,754 B1 * 1/2001 Wang et al. ..... 482/54
6,682,461 B1 * 1/2004 Wang et al. ..... 482/54
6,749,541 B1 * 6/2004 Martin ..... 482/54
6,783,482 B1 * 8/2004 Oglesby et al. ..... 482/54
6,824,502 B1 * 11/2004 Huang ..... 482/54

* cited by examiner

*Primary Examiner*—Glenn E. Richman
(74) *Attorney, Agent, or Firm*—Bacon & Thomas PLLC

(57) ABSTRACT

A control device for a jogging machine includes a stepping board, and a plurality of non-touch sensors arranged in line spaced apart equidistantly on two sides of the stepping board for sensing the position of the two feet of a user dropping on the stepping board for a controller to figure out the speed of the user and then adjust the speed of a moving band moving on and below the stepping board. The control device automatically adjusts the speed of the moving band to suit to the speed of the user's feet. Further, the control device has two angle adjusting sensors respectively fixed on two sides of a handle for adjusting the inclining angle of the stepping board by the user extending a hand nearer to either of the two adjusting sensors.

3 Claims, 2 Drawing Sheets

CONTROL DEVICE FOR A JOGGING MACHINE

BACKGROUND OF THE INVENTION

1. Field of the Invention

This invention relates to a control device for a jogging machine, particularly to one possible to control automatically the speed of the machine, in particular, the speed of a moving band for a user to walk, jog or run thereon, by checking and calculating the jogging speed.

2. Description of the Prior Art

A conventional jogging machine commonly has a moving band for a user to jog thereon, and if a user (jogger) wants to change the speed of the moving band, the user has to handle a switch on a panel located at the front portion of the machine. However, this kind of controlling the speed of the moving band involves the following drawbacks.

1. In trying to touch the switch for changing the moving speed, a user may lose stability of the center of gravity, so the switch is not easy to be touched.
2. A user may not be able to jog steadily and apt to fall down to be hurt, when the user is going to touch the switch with its jogging pace not well adjusted for changing the speed faster or slower.

SUMMARY OF THE INVENTION

The purpose of the invention is to offer a control device for a jogging machine, which can automatically control the jogging speed by checking his/her own pace and changing the speed of the moving band according to the speed of user's jogging or walking or running.

The feature of the invention is a stepping board, and non-touch sensors arranged spaced apart equidistantly in two lines on two lengthwise sides of the stepping board for sensing the positions of the feet of a user and the width of the paces and the time needed for the paces, and then the control device can adjust the speed of the moving band of the jogging machine to cope with the speed of the user jogging, walking or running.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
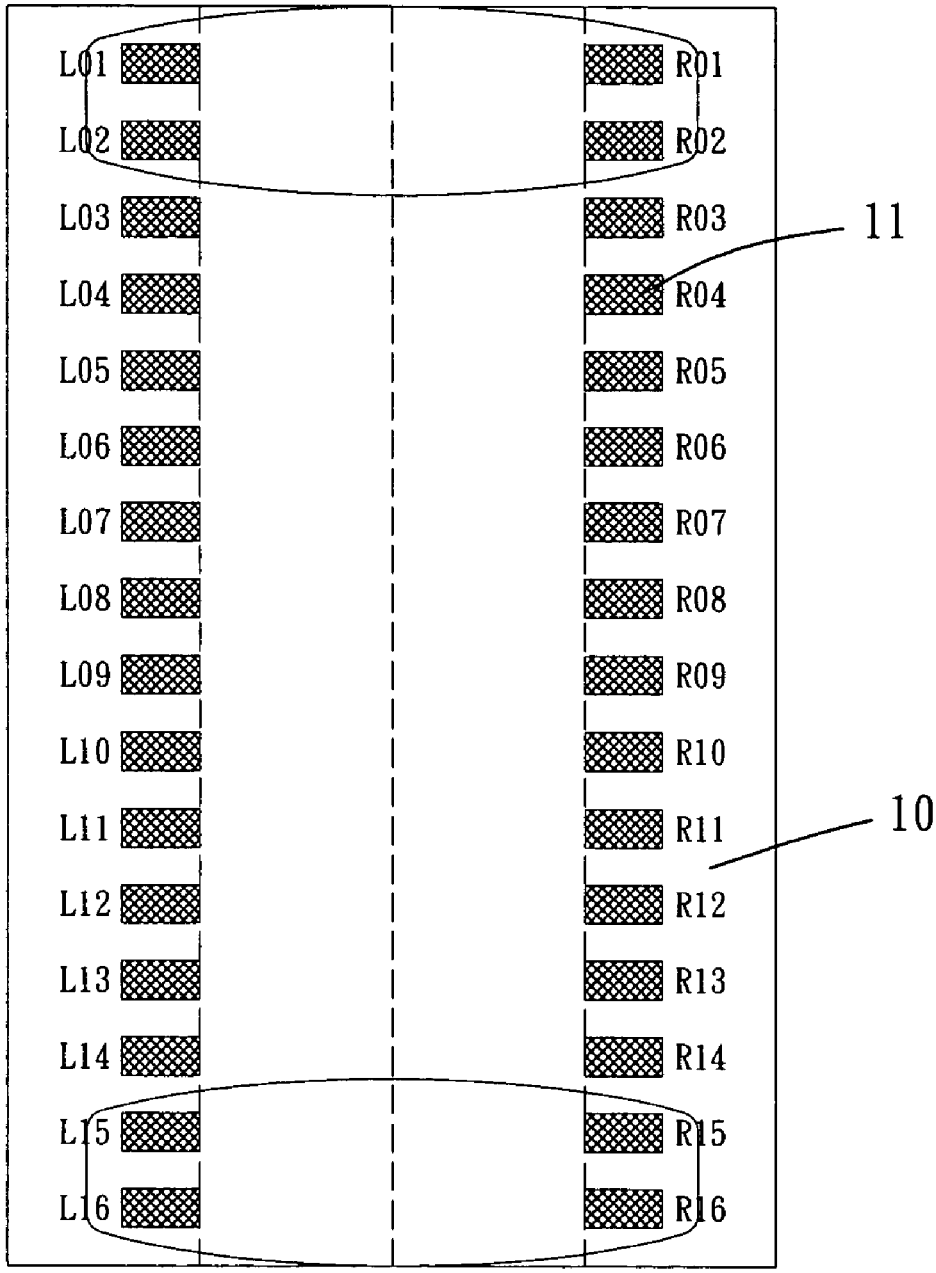
FIG. 1 is an upper view of a stepping board with sensors arranged thereon in the present invention.

A preferred embodiment of a control device for a jogging machine, as shown in FIG. 1, includes a stepping board 10, and a plurality of non-touch sensors 11 arranged spaced apart equidistantly in two lines on two lengthwise sides of the stepping board 10, and an endless band possible to move on and below the stepping board for a user to jog thereon.

The non-touch sensors 11 are arranged in a left line consisting of sixteen sensors, L01, L02, L03, L04, L05, L06, L07, L08, L09, L10, L11, L12, L13, L14, L15 and L16, and a right line consisting of sixteen sensors, R01, R02, R03, R04, R05, R06, R07, R08, R09, R10, R11, R12, R13, R14, R15 and R16. The areas where the sensors L01, L02, R01, R02, L15, L16, R15 and R16 are located are designated as dangerous areas, and if the feet of the user drop in these areas, then these sensors in those areas may send a signal to the program contained in the device so as to sound out an alarm.

In using, whether a user walks, jogs or runs on the stepping board 10, the contact and lifting positions of the two feet and their movement are sensed by some of the sensors 11, to provide a width and time measurement of the pace. The sensors 11 send signals corresponding to the width and time measurement to a controller, which figures out the speed of the user according to the data supplied by the sensors 11. Then the controller calculates and controls and changes the speed of the moving band according to the user's speed, without any handling by the user.

For example, if a user runs, with the left foot dropping at the location (contact position) of the sensor L05 and then pulling up at the location (lifting position) of the sensors L06 and L11, with the two feet staying in the air for a short period of time. Then the right foot drops at the location of the sensor R05 and then pulls up at the location of the sensors R06 and R11, and then the same movement is repeated. Then the controller can figure out the speed of the user depending on the data sensed by the sensors 11 about the moving speed of the two feet and the time needed, and then adjust the speed of the moving band accordingly. So a user can continue to jog, walk or run on the moving band on the stepping board 10, with no need to worry about the speed of the moving band whether it suits to the user's pace or not. Because it is effected completely by the control device, the jogging machine is quite convenient to use. In consequence, the user may never job unsteadily or fall down on the jogging machine with the control device in the present invention.

Figure 2:
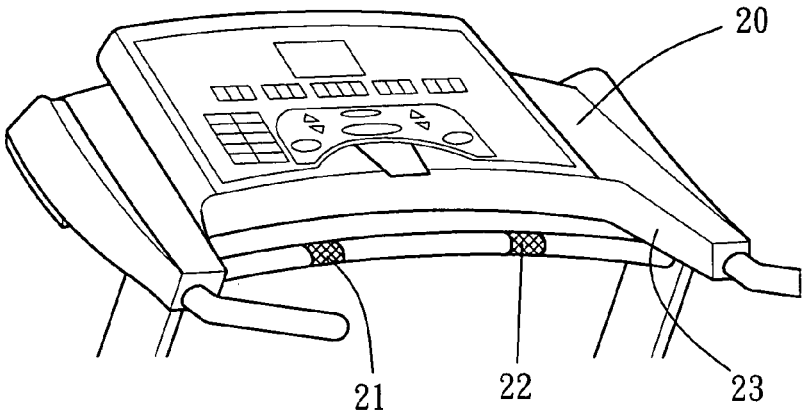
FIG. 2 is a perspective view of sensors for raising and lowering the stepping board in the present invention; and, FIG. 3 is an upper view of the sensors for raising and lowering the stepping board in the present invention.
Figure 3:
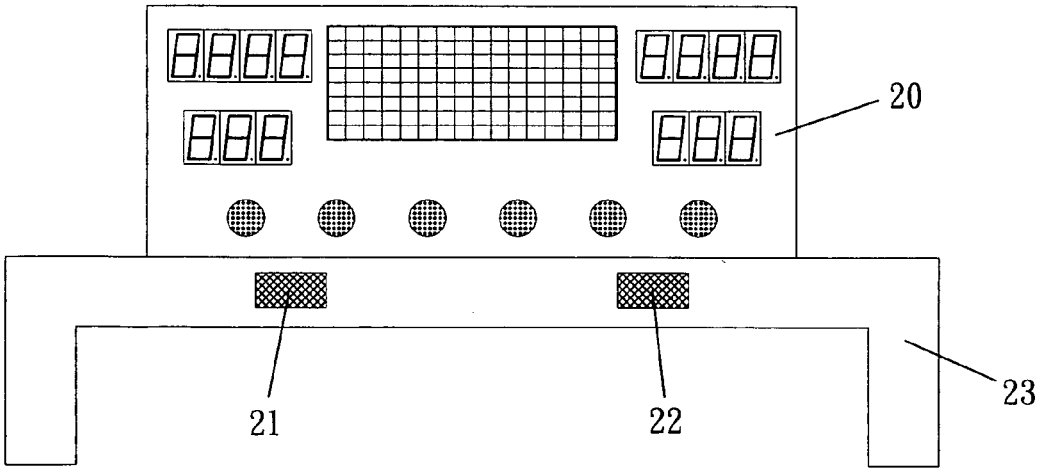

Next, as shown in FIGS. 2 and 3, a raising sensor 21 and a lowering sensor 22 are provided respectively on the two sides of a panel 20 (or a handle 23 shown in the FIGS. 2 and 3) for raising or lowering the front end of the stepping board. The two sensors 21 and 22 are also non-touch ones. If a user wants to adjust the inclining angle of the front end of the stepping board 10 during jogging, the user can do it by extending a hand nearer to either of the raising and the lowering sensors 21 and 22.

The invention has the following advantages, as can be understood from the foresaid description.

1. A user can control the speed of the moving band of the jogging machine, without need of touching an optional switch as needed in the conventional jogging machine.
2. A user can adjust the inclining angle of the stepping board by extending a hand nearer to the raising and the lowering sensor 21 and 22, without touching.

While the preferred embodiment of the invention has been described above, it will be recognized and understood that various modifications may be made therein and the appended claims are intended to cover all such modifications that may fall within the spirit and scope of the invention.

What is claimed is:

1. A control device for a jogging machine comprising:

a stepping board provided with a plurality of non-touch sensors arranged in two lines spaced apart equidistantly on two sides of said stepping board, and an endless band moving on and under said stepping board for a user to jog thereon; and a controller connected with said non-touch sensors electrically;

wherein said sensors sense contact positions and lift positions of two feet of a jogger on said stepping board to provide a width and time measurement of a pace of the jogger to said controller, said controller determines the speed of the user from said width and time measurement, and said controller controls the speed of said moving band according to the speed of the user.

2. The control device for a jogging machine as claimed in claim 1, further comprising a raising sensor and a lowering sensor for adjusting the inclining angle of said stepping board, said raising sensor and said lowering sensor comprising non-touch sensors, fixed respectively on two sides of a handle facing a user so that the user can extend a hand nearer to said raising sensor or said lowering sensor for adjusting the inclining angle of said stepping board.

3. The control device for a jogging machine as claimed in claim 1, wherein a front end portion and a rear end portion of said stepping board are designated as dangerous areas, and those sensors located in said dangerous areas sense a user's foot and command a software program to give out an alarm.

* * * * *